US006920315B1

(12) United States Patent
Wilcox et al.

(10) Patent No.: US 6,920,315 B1
(45) Date of Patent: Jul. 19, 2005

(54) MULTIPLE ANTENNA IMPEDANCE OPTIMIZATION

(75) Inventors: Bruce Emerson Wilcox, Cary, NC (US); Mark Gordon Douglas, Cary, NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/532,922

(22) Filed: Mar. 22, 2000

(51) Int. Cl.[7] ..... H01Q 11/12

(52) U.S. Cl. ..... 455/121; 455/107; 455/123; 343/913

(58) Field of Search ..... 455/107, 121, 455/123, 125, 128, 129, 87, 562, 19, 120; 343/913, 702, 725, 742

(56) References Cited

U.S. PATENT DOCUMENTS

| | | | | | |
|---|---|---|---|---|---|
| 3,681,706 | A | * | 8/1972 | Harzer | 331/1 A |
| 4,233,607 | A | | 11/1980 | Sanford et al. | 343/700 |
| 4,549,312 | A | * | 10/1985 | Michaels et al. | 455/311 |
| 4,701,732 | A | * | 10/1987 | Nestlerode | 327/434 |
| 4,806,944 | A | | 2/1989 | Jacomb-Hood | |
| 5,060,293 | A | | 10/1991 | Kok et al. | 455/78 |
| 5,264,862 | A | | 11/1993 | Kumpfbeck | 343/853 |
| 5,589,844 | A | * | 12/1996 | Belcher et al. | 333/17.3 |
| 5,596,313 | A | * | 1/1997 | Berglund et al. | 340/574 |
| 5,729,236 | A | * | 3/1998 | Flaxl | 342/374 |
| 5,771,449 | A | | 6/1998 | Blasing et al. | 455/422 |
| 5,784,032 | A | * | 7/1998 | Johnston et al. | 343/702 |
| 5,815,805 | A | | 9/1998 | Crnkovic et al. | 455/78 |
| 5,842,117 | A | * | 11/1998 | Rosenberg et al. | 455/101 |
| 6,005,530 | A | * | 12/1999 | Jovanovich et al. | 343/827 |
| 6,072,993 | A | * | 6/2000 | Trikha et al. | 455/78 |
| 6,115,585 | A | * | 9/2000 | Matero et al. | 455/78 |
| 6,195,559 | B1 | * | 2/2001 | Rapeli et al. | 455/500 |
| 6,211,830 | B1 | * | 4/2001 | Monma et al. | 343/702 |
| 6,215,456 | B1 | * | 4/2001 | Nakanishi | 343/895 |
| 6,256,495 | B1 | * | 7/2001 | Francisco et al. | 455/426 |

FOREIGN PATENT DOCUMENTS

| | | |
|---|---|---|
| CA | 2095304 | 4/1993 |
| EP | 0 465 315 A1 | 6/1991 |
| EP | 0 680 161 A1 | 4/1995 |

* cited by examiner

*Primary Examiner*—Charles Appiah
*Assistant Examiner*—Nghi H. Ly
(74) *Attorney, Agent, or Firm*—Coats & Bennett, P.L.L.C.

(57) ABSTRACT

A multiple antenna mobile communication device, such as a cellular telephone, having multiple radios and multiple antennas located in close proximity to each other uses a parallel tuning circuit to optimize the isolation between the antennas. The parallel tuning circuit can include multiple impedance matching circuits to match the impedance in multiple frequency bands or isolating antennas.

7 Claims, 4 Drawing Sheets

MULTIPLE ANTENNA IMPEDANCE OPTIMIZATION

BACKGROUND OF THE INVENTION

1. Field of the Invention

The present invention relates in general to multiple antenna impedance optimization. In particular, the present invention relates to a method and apparatus for impedance transformation between two antennas in close proximity to each other.

2. Background

Cellular radiotelephones, combined cellular and satellite radiotelephones, and other wireless communications devices often employ two or more antennas, each of which are connected with a separate radio. Due to the limited space on most wireless devices, it is highly desirable to locate these antennas close together. However, without isolating the electromagnetic coupling between the antennas, there is a limitation on how closely the antennas can be spaced from each other. Coupling between the antennas creates several problems, including: reducing the gain of each antenna because some of the radiated power from each antenna is absorbed by the other antenna; creating tuning and impedance mismatches in each antenna, causing mismatch loss and/or lower impedance bandwidth; mixing of signals which can result in spurious emissions; and damaging of a receiver of one radio by a strong signal transmitted from the other radio.

Multiple antenna isolation can be achieved by placing a circuit in series between the radio transmitter and its antenna. Examples of series circuits are filters, switches, and directional attenuators. A series filter circuit presents a lower insertion loss across the frequency band of the first antenna and a higher insertion loss across the frequency band of the second antenna. A switch is closed when its antenna is in use and open when the second antenna is in use. The switch should be located near the base of the antenna to ensure that the length of transmission line between the switch and the antenna base does not transform the open circuit impedance at the switch to some other impedance as described in U.S. Pat. No. 5,060,293. A filter in combination with a directional attenuator provides antenna isolation as described in U.S. Pat. No. 5,815,805. A shortcoming of filters is the insertion loss, which can be significant. A shortcoming of using a switch is that the switch must be located very close to the base of the antenna.

Multiple antenna isolation can be achieved by creating a canceling signal (interference signal) in a third antenna that cancels the signal from the second antenna, as described in U.S. Pat. No. 4,233,607. This method requires additional hardware including an antenna and a signal generator signal to generate the canceling signal. Multiple antenna isolation can also be achieved by anti-phase combination of signals as described in U.S. Pat. No. 5,264,862. Multiple antenna isolation can also be achieved by using uncorrelated radiating modes as described in Canadian patent 2,095,304. Using uncorrelated radiating requires the two antennas to be oriented in one of a limited number of possible orientations to create orthogonal polarization and radiation patterns. Such limited orientations prohibit using this method in many applications with physical space constraints. Further, this method can be applied to at most three antennas. Multiple antenna isolation can also be achieved by arranging narrow beamwidth antennas sectorally such that their radiation patterns do not overlap as described in U.S. Pat. No. 5,771,449. However, sectoral arrangement is impractical in most applications with size constraints, such as cellular telephones.

A wide band antenna can be used with a frequency diplexing circuit to separate the communication signals into the appropriate frequency bands. For example, a single antenna in a cellular telephone can be used to simultaneously transmit and receive cellular telephone calls. These designs have several disadvantages. First, a single feed point wide band antenna with multiple radios attached is difficult to design. Second, the frequency diplexing circuit exhibits high insertion loss. Higher insertion loss causes lower communication quality and higher battery current consumption rates, which decreases the operational time in battery operated devices.

Alternatively, a multiple pole switching circuit can separate transmit and receive frequency ranges on a wide band antenna. The multiple pole switching circuit has three primary disadvantages: high insertion loss, increased current consumption, and lower linearity. Lower linearity is a result of an increase in spurious emissions during transmitting and an increase in spurious input signals during receiving.

A dual-mode phone operates on two modes, usually digital and analog. For example, a dual-band phone operates on the cellular band (800 MHz) and the PCS band (1900 MHz).

A brief summary of the mobile standards commonly used includes:

Multiple access techniques: FDMA allows multiple stations to use different frequencies within an operating frequency channel. Time Division Multiple Access (TDMA) allows mobile stations to use the same frequency, but signals are separated by time slots. Code Division Multiple Access (CDMA) allows multiple mobile stations to use the same frequency, but signals are separated by unique digital codes. CDMA uses spread spectrum techniques. Personal Communication Services (PCS) is a digital communication standard that is commonly referred to as the 1900 MHz (1.9 GHz) band. However, the band is actually from 1850 MHz to 1990 MHz.

Operating modes that use one or more multiple access techniques: Advanced Mobile Phone System (AMPS) is an analog system used in the United States for cellular telephones. AMPS uses Frequency Modulation (FM) and the FDMA air interface. The frequency band for AMPS is 824 MHz to 849 MHz and 869 MHz to 894 MHz. Each channel is 30 KHz wide. Narrow-band Advanced Mobile Phone Service (NAMPS) operates with the 30 KHz channels used in AMPS divided into three 10 KHz channels. Global System for Mobile Communications (GSM) is a European standard for digital wireless communications. GSM uses a combination of FDMA and TDMA. GSM divides the 25 MHz band into 124 frequencies of 200 KHz each. GSM uses 8 time slots rotated at 214 times per second. GSM in the United States uses the PCS band (1900 MHz). Digital Advanced Mobile Phone System (DAMPS), like GSM, uses TDMA and FDMA. However, DAMPS uses 3 time slots rotated at 50 times per second. Bluetooth is a specification for short range radio links between mobile PCs, mobile phones and other portable devices. Bluetooth radios operate in the unlicensed ISM band at 2.4 GHz and use a time-division duplex scheme for full-duplex transmission. The range of Bluetooth is only from 10 cm to 10 m, but can be extended to 100 m. Thus, Bluetooth is useful as a data link between a cellular telephone and a near by computer. Mobile satellite telephones, communicate via satellites instead of cellular base stations. Such phones are available from IRIDIUM and GlobalStar.

FIG. 1 shows a typical prior art multiple antenna system 100 with two radio antenna systems 102, 104 that uses series circuits. The radio antenna system 102 includes a radio 110, an antenna 114, and a series circuit 112, in series between the radio 110 and antenna 114. The radio antenna system 104 includes a radio 120, an antenna 124, and a series circuit 122 in series between the radio 120 and antenna 124.

SUMMARY

The present invention is defined by the following claims, and nothing in this section should be taken as a limitation on those claims. By way of introduction, the preferred embodiments described below include a mobile communication device, such as a cellular telephone, with multiple radios and antennas located in close proximity to each other. A parallel tuning circuit connectable to the signal path adjusts the impedance in an antenna in order to reduce the interference (coupling) between the antennas. The parallel tuning circuit can include multiple impedance matching circuits.

DETAILED DESCRIPTION OF THE PREFERRED EMBODIMENTS

The present invention, in one embodiment, can incorporate a cellular telephone with a first antenna and an additional antenna and radio for communicating with a personal computer(PC) using the Bluetooth interface. Since antenna interference (coupling) in a multiple-antenna system can de-tune the antenna, causing damage to the radio attached to the non-transmitting antenna, and other problems, antenna isolation is required. Physical isolation is not practical in a handheld device because of space limitations. The present invention includes a parallel impedance circuit that is selectively connected near the base of the first antenna to isolate the second antenna from the first antenna when the second antenna is operational.

Advantages of this invention include reduced power consumption, reduced antenna sizes, the ability to locate multiple antennas closer together, reduced coupling between antennas, reduced feedback in radios, better impedance matching, and reduced spurious emissions.

While a cellular telephone has been used as an example, the present invention can apply to numerous devices, especially small handheld devices with multiple antennas. For example, a Global Positioning System (GPS) unit with a Bluetooth interface, each having their own antenna would need antenna isolation.

Figure 1:
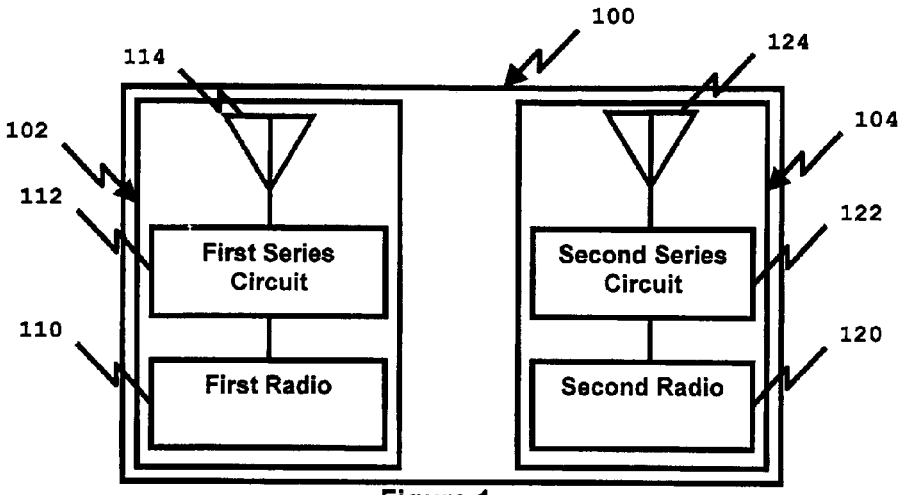
Figure 1 Prior Art
FIG. 1 is a diagram representing a prior art system with two radio antenna systems in close proximity using a series tuning circuit.
Figure 2:
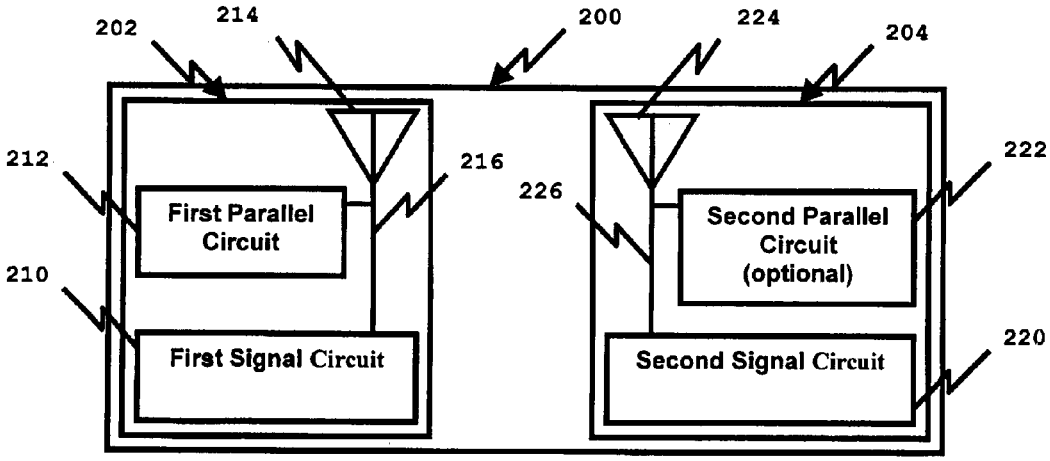
FIG. 2 is a diagram representing a system with two radio antenna systems in close proximity incorporating a parallel tuning circuit.

FIG. 2 is an embodiment of the invention, a multiple antenna system 200 with two antenna systems 202, 204. The first antenna system 202 includes a signal circuit 210, an antenna 214, and a parallel circuit 212 in parallel with the signal circuit 210 and antenna 214. The second antenna system 204 includes a signal circuit 220, an antenna 224, and optionally a parallel circuit 222 in parallel with the signal circuit 220 and antenna 224. The antennas 214, 224 are located in close proximity (within approximately one wave length or less) to each other. Two antennas are in close proximity when a transmission from one antenna is affected by the presence of the other antenna. The signal circuits 210, 220 can be transmitters, receivers, or transceivers for radios, cellular telephone radios, walkie-talkies, GPS systems or other circuits that transmit and/or receive a signal over an antenna.

The parallel circuit 212 is preferably connected as close to the antenna 214 as practical. By locating the parallel circuit 212 close to the antenna 214, the RF power loss of the transmission path is decreased.

In an embodiment, only the first antenna system has a parallel circuit. In this embodiment, only the antenna system wit h the parallel circuit is isolated from the other antenna. In an alternative embodiment, both antenna systems 202, 204 are connected with parallel circuits 212, 222.

Also, the parallel circuit can be applied to a multiple antenna system with more than two antennas. For example, a multiple antenna system can have two (2) to ten (10), or more antenna systems located physically close to each other. There is no known practical limit to the number of antennas in the multiple antenna systems implementing the disclosed invention.

In a preferred embodiment, the second signal circuit 220 can generate signals in multiple frequency bands, and the first parallel circuit 212 can maximize the antenna to antenna isolation. The first parallel circuit 212 can include an impedance matching circuit or other tuning circuit. Alternatively, the first parallel impedance matching circuit may be used to indirectly or directly correct the impedance mismatch between the second antenna 224 and the second signal circuit 220.

Optionally, the multiple antenna system 200 can include a second parallel circuit 222 selectively connectable to the second signal path 226. The second parallel circuit 222 can reduce the coupling between the first and second antennas 214, 224 by presenting a high insertion loss between the antenna 224 and the signal circuit 220 when the signal circuit 210 is in use and a low insertion loss between the same points when the signal circuit 220 is in use.

It is preferable that the first parallel circuit 212 be connected to the first signal path 216 near the first antenna 214 and create a termination impedance at the input to the first antenna 214 equivalent to an open circuit when the second signal circuit is in use. The first parallel circuit 212 can include active or passive components.

Further, the first parallel circuit 212 can be used to improve the impedance match between the second antenna 224 and the second signal source 220. Because the two antennas 214, 224 are in close proximity with each other, the impedance match of the second antenna 224 is affected by the presence of the first antenna 214. The first parallel circuit 212 can create a terminating impedance in the first antenna 214 that adjusts the impedance match in the second antenna 224. It is preferred that active controls be used to perform this function.

Figure 3:
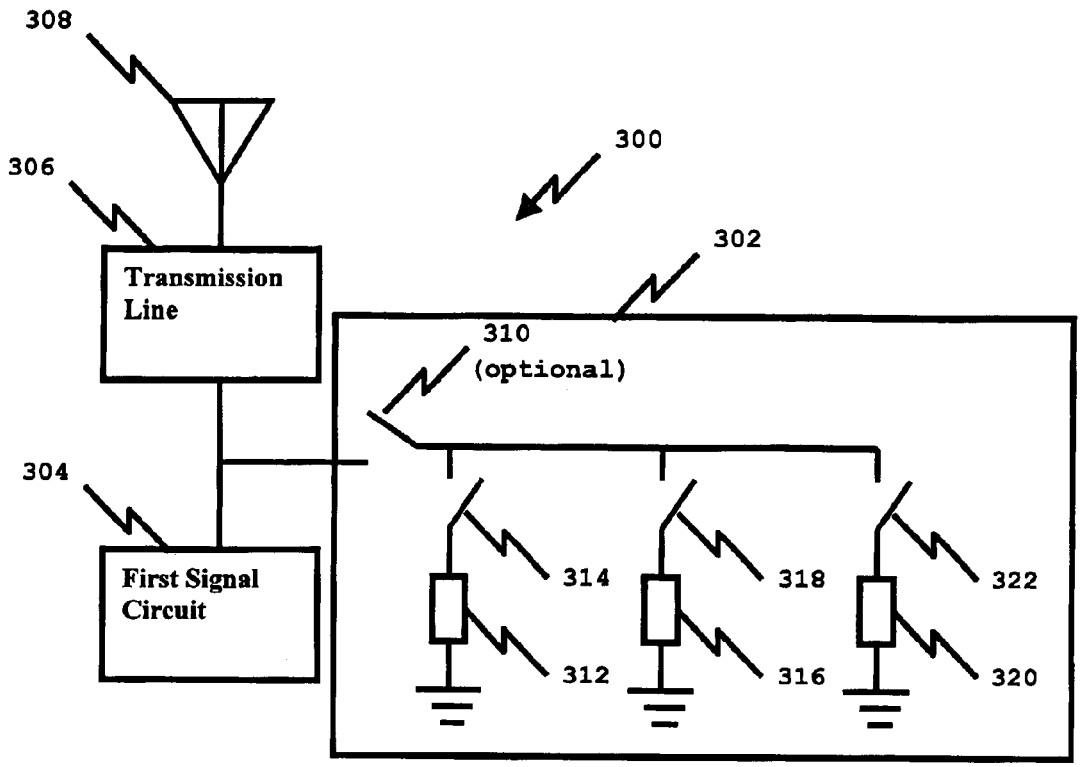
FIG. 3 is a diagram representing a radio antenna system incorporating a parallel tuning circuit.

FIG. 3 shows an antenna system 300 that includes a first signal circuit 304, such as a radio, connected with an antenna 308 via a transmission line 306. Also, a parallel circuit 302 is selectively connectable to the transmission line 306. In an embodiment, the parallel circuit 302 includes a main switch 310, and one or more secondary switches 314, 318, 322. The main switch 310 connects or disconnects the parallel circuit 302 from the rest of the radio antenna system 300. Each secondary switch 314, 318, 322 connects a tuning circuit 312, 316, 320 to the main switch. The tuning circuits 312, 316, 320 are also called impedance matching circuits. While FIG. 3 illustrates one embodiment of the present invention that includes a main switch and a plurality of secondary switches, numerous alternative configurations also achieve the desire result of selectively connecting one or more of the tuning circuits 312, 316, 320 to the transmission line 306.

A tuning circuit, e.g. 312, can include a band tuning circuit. When the first signal circuit 304 is not in use, the band tuning circuit tunes the first antenna 308 to a specific impedance, such that the antenna to antenna isolation is maximized in a predetermined frequency band.

While a primary purpose of the parallel tuning circuit 302 is to reduce interference between antennas in a multiple antenna system, a parallel tuning circuit can also be used to compensate for external: signal interference. External interference can result from a variety of sources including placing a hand near the cellular telephone antenna. Such external interference detunes the antenna. It is preferable that such a tuning circuit be automatically connectable to the transmission line 306 to dynamically compensate for the external interference. Optionally, an interference detector or other detector can be used to dynamically connect one or more of the tuning circuits with the first signal path.

In an embodiment, at least one of the plurality of tuning circuits 312, 316, 320 maximizes the isolation between the first and second antennas, and the other tuning circuits maximize the isolation between the first antenna and other adjacent antennas. It is preferred that the tuning circuits 312, 316, 320 match the impedance in multiple frequency bands. In another embodiment, the tuning circuits 312, 316, 320 maximize the isolation between the first and second antennas in various operating environments.

Each of the plurality of impedance matching circuits 312, 316, 320 can be independently selectively connectable in parallel with the other tuning circuits to the transmission line.

The signal circuit 304 can generate and/or receive electromagnetic signals, preferably radio signals or cellular telephone signals. In a multiple antenna system with multiple signal circuits, the signal circuits may generate signals at the same or different frequencies bands.

In an embodiment, the multiple antennas can be formed on a common material, such as a dielectric substrate. The tuning circuit can be created on a single semiconductor or it can be made using micro-electro-mechanical systems ("MEMS") technology. It is preferred that the switches be MEMS switches.

Figure 4:
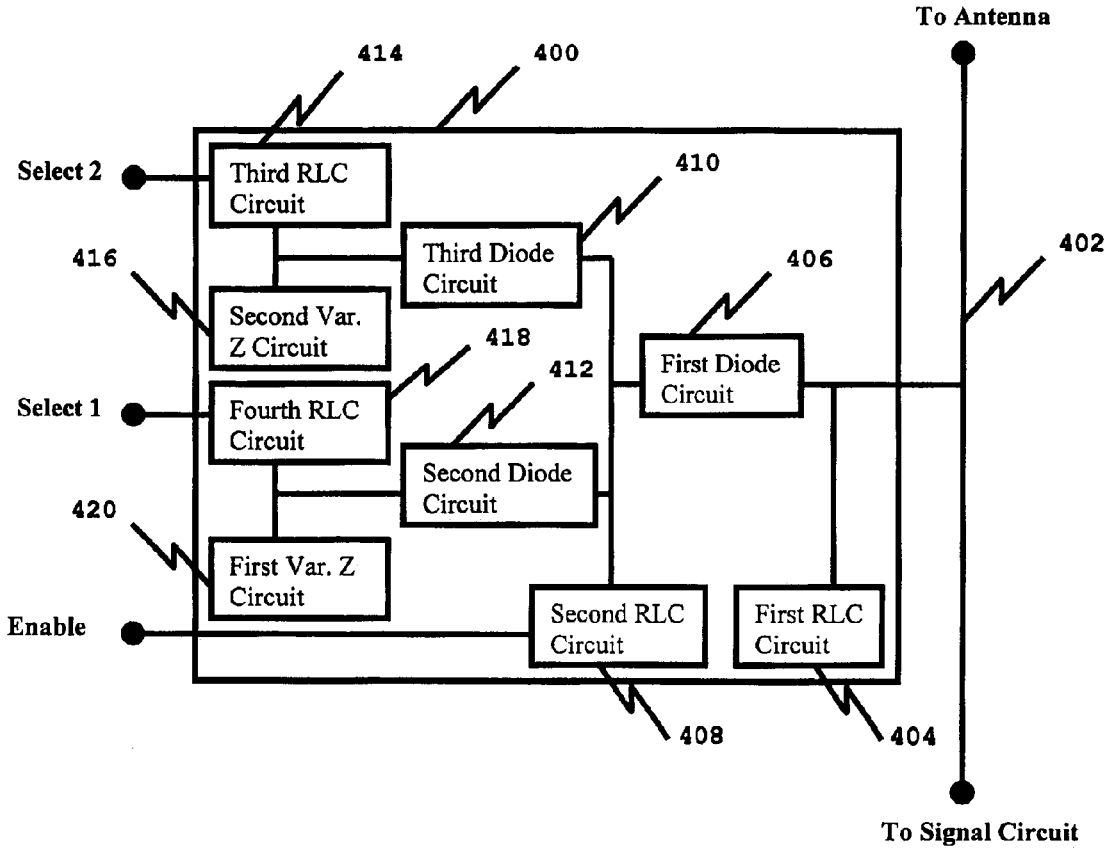
FIG. 4 is a schematic diagram of a parallel tuning circuit.

FIG. 4 shows an embodiment of a parallel circuit 400 connected with a transmission line 402 with two tuning circuits. The embodiment of a parallel circuit 400 is one of many possible embodiments of the parallel circuit 212, 222 (FIG. 2), or 302 (FIG. 3). For example, RLC circuit 418, diode circuit 412 and variable impedance circuit 420 are equivalent to tuning circuit 312 and switch 314 and RLC circuit 414, diode circuit 410 and variable impedance circuit 416 are equivalent to tuning circuit 316 and switch 318. The parallel circuit 400 includes four RLC circuits 404, 408, 414, 418, three diode circuits 406, 410, 412, and two variable impedance circuits 416, 420. The parallel circuit 400 has three inputs labeled "Enable", "Select 1", and "Select 2". The three inputs control how the parallel circuit 400 affects the signal path. Each RLC circuit 404, 408, 414, 418 includes an inductor, a resistor, and a capacitor, preferably connected in a "T" configuration.

The diode circuits 406, 412, 410 preferably include PIN diodes. PIN diodes are commonly used for switching and attenuating RF (radio frequency) signals. A PIN diode has P-doped and N-doped regions with an undoped, "intrinsic", region in between. When the PIN diode is forward biased to conduct current, it will also conduct a high-frequency signal superimposed on the current, even if the signal is large, with minimal distortion to the high-frequency signal. The PIN diode, used at high frequencies, is similar to a variable resistor, whose resistance decreases as current increases.

Control signals are applied at the Enable, Select 1, and Select 2 terminals. The control signals are generated as desired to control the parallel circuit 400. It is preferred that an automated circuit generate the control signals based on the operating state of the antennas in the multiple antenna system. It is preferred that low leakage bipolar transistor circuits drive the control signals.

TABLE 1

| Operational Mode/Controls | Enable | Select 1 | Select 2 |
|---|---|---|---|
| Transmission | Floating | Floating | Floating |
| Isolation Band 1 | +3.0 Vdc | 0 Vdc | Floating |
| Isolation Band 2 | +3.0 Vdc | Floating | 0 Vdc |

Table 1 illustrates an embodiment of the operating modes and the control signals associated with each operating mode for the parallel circuit in FIG. 4. Table 1 assumes that the parallel circuit 400 (FIG. 4) is used in a multiple antenna system such as 202 (FIG. 2) or 300 (FIG. 3) and that the parallel circuit can isolate two frequency bands "Isolation Band 1" and "Isolation Band 2" as well as allow the signal circuit to transmit a signal. The isolation frequency bands can be any frequency ranges desired.

Since the parallel circuit 400 is used in a multiple antenna system, it is preferred that one of the bands isolate the frequencies used by other antennas. Thus, in a multiple antenna system with three antenna systems, the first antenna system may have a parallel circuit and "isolation band 1" may correspond to the second antenna system's transmitting frequency, and "isolation band 2" may correspond to the third antenna system's transmitting frequency. Isolation band 1 is used in the parallel circuit connected with the first antenna system when the second antenna system is transmitting. Likewise, isolation band 2 mode is used in the parallel circuit 400 connected with the first antenna system when the third antenna system is transmitting. It is preferred that isolation band 1 and isolation band 2 be different frequency ranges. However, they may overlap. The control signals, Enable, Select 1, and Select 2, can be digitally controlled from a control input circuit. The control input circuit can be manually operated or preferably automatically operated based on the transmit and receive states of each antenna in the multiple antenna system. The control input circuit can sense the states of each antenna and apply appropriate signals to the control inputs to all antennas with parallel circuits. It is preferred that low leakage bipolar transistors drive the control inputs.

The "transmission mode" is used when the antenna system connected with the parallel circuit 400 is transmitting or receiving and the other antennas are not transmitting. When the "transmission mode" is used, the Enable, Select 1, and Select 2 are allowed to float. When all three inputs are allowed to float, the parallel circuit 400 is in "thru" mode and the parallel circuit 400 does not tune the antenna. When the band 1 is to be isolated, the "isolation band 1" mode is used and 3 volts DC is applied to Enable, zero volts is applied to Select 1, and Select 2 is allowed to float. When the band 2 is to be isolated, the "isolation band 2" mode is used and 3 volts DC is applied to Enable, Select 1 is allowed to float, and zero volts is applied to Select 2. The isolation modes are preferably used on the first tuning circuit when the first antenna is not transmitting and an other antenna is transmitting. The modes and controls of Table 1 also apply to the parallel circuit 504 shown in FIG. 5.

Figure 5:
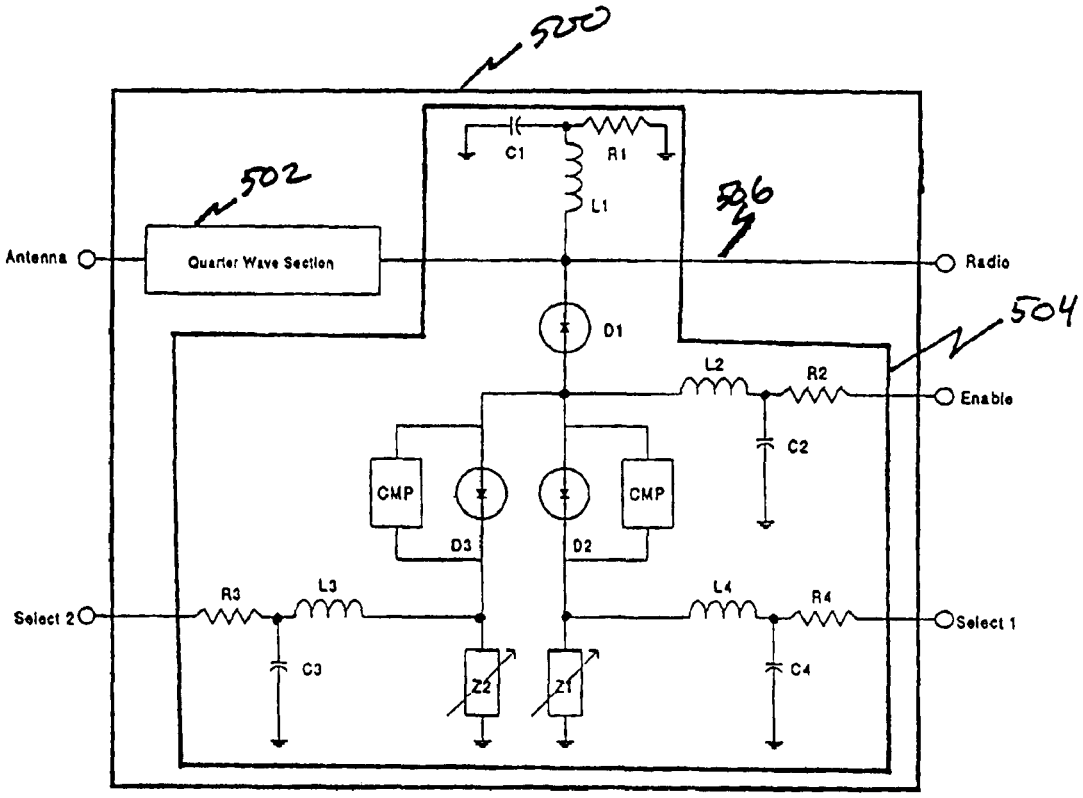
FIG. 5 is a circuit diagram representing an embodiment of the present invention.

FIG. 5 is an embodiment of a circuit 500 with a transmission line 506, a quarter wave section ("QWS") 502, and a quarter wave termination circuit ("QWT circuit") 504 also called a parallel circuit. The QWT circuit 504 is an embodiment of the parallel circuit 400 (FIG. 4). The transmission line 506 includes a quarter wave section 502. The quarter wave section ("QWS") 502 is a transmission line which is a quarter-wavelength long at the lowest operational frequency. The QWS 502 can include transmission line elements or discrete components. It is preferred that the QWS 502 have small size and low insertion loss. The parallel circuit 500, in a preferred embodiment, is formed on a substrate, such as a semiconductor substrate. The parallel circuit 500 includes four "T" shape RLC circuits, three diode circuits, and two variable impedance circuits (Z circuits). The compensation circuits ("CMP") are optional impedance compensation circuits that are required only to optimize the off state PIN diode impedance over multiple frequency bands. The three diodes, D1, D2, D3, are preferably PIN diodes.

The transmission line 506 extends between a signal source (e.g. a radio) and an antenna. The radio can transmit or receive one or more of a variety of radio frequency signals. For example, the radio may transmit on a first frequency range and receive on a second frequency band. The three control inputs are labeled "Select 1", "Select 2", and "Enable" and they control the operation of the parallel circuit 500 as described in Table 1.

When the parallel circuit 500 is in the transmission mode, the signal (e.g. radio frequency energy) passes from the radio node to the antenna node with a low insertion loss and high linearity. In the transmission mode, the quarter wave section ("QWS") 502 provides a low insertion loss and the quarter wave termination circuit ("QWT circuit") 504 provides high impedance with high linearity. In the transmission mode, it is preferred that the QWS 502 mirror the characteristics of a 50 ohm transmission line. In a preferred embodiment, the QWS 502 has an insertion loss below 0.30 dB at 2 GHz.

In the transmission mode, the QWT circuit 504 is not biased and provides a low loss and high linearity. Low loss exists when the QWT circuit 504 provides a high "off" state impedance. High linearity is defined as having second and third order intercept points that are substantially infinite. For design reasons, low loss levels and high linearity are traded off. It is preferred that the QWT 504 have an insertion loss of less than 0.15 dB at 2 GHz. When in the transmission mode (thru mode), it is preferred that the QWT 504 should have an insertion loss of less than 0.55 dB.

In the transmission mode, the three control inputs are allowed to float and thus, the diodes, D1, D2, D3, are not biased. Since the QWT is a parasitic impedance to ground, the PIN diode off state impedance dominates the overall transmission mode insertion loss. As the diode's off state impedance increases, the overall network loss decreases. If PIN diodes are used, a high impedance parallel RLC circuit will result. The QWT circuit 504 acts as a parasitic impedance to ground, causing the PIN diode off state impedance to dominate the transmission mode insertion loss. As the diode off state impedance increases, the loss decreases. The two optional impedance compensation circuits labeled "CMP" in FIG. 5 are used to optimize the off state PIN diode impedance over multiple frequency bands. The QWT 504 illustrated in FIG. 5 does not require a reverse bias voltage.

In conventional systems, such as applications used for the Global System for Mobile telecommunication ("GSM") standard, shunt PIN diodes require a reverse bias voltage to prevent peak RF voltages from turning on the shunt diodes. If the shunt PIN diode turns on during the RF power transmission, the diodes drain the current from the transmission signal. This can result in the creation of numerous undesirable spurious radio frequency artifacts. Two methods can prevent the shunt diodes from turning on. First, traditional systems use a large reverse bias voltage applied to the PIN diode to ensure it does not turn on. Second, the parallel circuit prevents the radio frequency voltage from reaching the return path to ground. The QWT circuit 504 prevents the radio frequency from reaching the ground path by providing anode-to-anode diode configurations, D1 to D2 and D1 to D3, coupled with the "T" bias circuits (RLC circuits).

D1 of FIG. 5 will turn on when the current flows through D2, D3 or the second RLC "T" bias circuit (L2, R2, C2). An embodiment of D1 is shown in FIG. 3 as a switch 310. That is, D1 is turned n when a positive voltage is applied to the "Enable" input Since D1 is orientated anode-to-anode with respect to D2 and D3, D1 will not turn on simultaneously with D2 or D3 when a peak negative radio frequency voltage is transmitted on the transmission path 506. Thus, the only current path to ground for the peak negative voltage is through the first RLC "T" circuit (L1, R1, C1). The inductors L1, L2, L3, and L4 are high impedance radio frequency chokes. The chokes (L1, L2, L3, and L4) prevent the radio frequency current from finding a return path to ground. The capacitors C2, C3, C4, reference one end of the radio frequency chokes L2, L3, L4, respectively, to ground. This prevents performance anomalies resulting from the bipolar driver transistor parasitics.

The QWT circuit 504 provides numerous advantages over existing series tuning circuits. For example, in the transmission mode (thru mode) the QWT circuit 504 drains no current and provides increased linearity. A series PIN circuit requires up to 10 mA (GSM at 2 Watts) to optimize insertion loss and linearity. Some low loss PIN diodes are currently manufactured using an "Epi" process and high linearity diodes are manufactured using a less expensive "bulk" process.

The second mode of operation for the QWT circuit 504 is the "isolation mode", also called isolation band mode. The isolation mode presents a specific impedance at the antenna feed point. The impedance is selected to optimize the antenna-to-antenna isolation. It is preferable that the impedance be digitally selectable. In a preferred embodiment, the selection is dynamic, adapting to changes in the environment. The method of selecting the appropriate impedance is called quarter wave matching. The impedance looking into a quarter wave section is a function of the quarter wave section output port termination. If the output port is terminated in a zero Ohm impedance (a short to ground), the impedance seen at the quarter wave section input port is extremely high, that is an open circuit, at that specific frequency. If the output port is terminated in a high impedance, that is an open circuit, the impedance seen at the quarter wave input port is extremely low, that is a short.

The QWS 502 terminating impedance is selected by applying a bias voltage at both the "enable" node and one of the two "select" nodes, Select 1and Select 2. The bias voltage turns on PIN diode D1 and one, but not both PIN diodes D2 and D3. The diodes are used to select the desired QWS 502 termination impedance. As variable impedance circuit Z1 or Z2 increase in inductance, the QWS 502 input reflection coefficient position rotates clockwise on the Smith chart (not shown), a circular graphical device commonly used in the industry. The variable impedance circuits Z1 and Z2 can include inductance and/or capacitance circuits. As variable impedance circuit Z1 or Z2 decrease in inductance, the QWS 502 input reflection coefficient position rotates counter clockwise on a Smith chart. As the QWS 502 input reflection coefficient changes position on the Smith chart, the associated impedance is scaled.

The relationship between the reflection coefficient ρv looking into the QWS 502 from the antenna and the input impedance Zin at the same location is given by Equation 1.

$$Zin=(Zo*(\rho v+1))/(1-\rho v) \quad \text{Eqn. 1}$$

Zin is the input impedance

Zo is the system characteristic impedance

ρv is the reflection coefficient

The QWS 502 scales the termination impedance at the desired frequency.

The QWS 502 is designed to be a quarter wave circuit at the lowest operational frequency band. If isolation is desired in the lowest operational frequency band, a large capacitor is used for the Z1 termination. A capacitor that acts as a short circuit at radio frequencies is called a RF short. If a RF short is used to terminate the input port of a QWS 502, the output port impedance will have an extremely high impedance, that is effectively an open. The output port of the QWS 502 is the end closest to the antenna and the input port is the end closest to the radio. As the operational frequency increases, Z1 will not terminate the QWS 502 in the proper impedance. The problem is that the electrical length of the QWS 502 becomes too long as the operational frequency increases. To correct this problem, the Z2 termination impedance is switched on to normalize the QWS 502 electrical length. After normalization, the QWS 502 input port has a high impedance in the desired frequency range.

The resolution of the impedance selection is a function of the number of network stages. Higher resolution requires more stages.

This parallel circuit 504, also called a termination stage, can be used on a single antenna in a multiple antenna system or more than one antenna in the multiple antenna system. In a preferred embodiment, every antenna in a multiple antenna system is connected with a parallel circuit 504.

The parallel circuit 504 provides several advantages over the existing systems. First, the impedance is digital selectable via the Enable, Select 1, and Select 2. Second, the parallel circuit 504 can isolate multiple bands without requiring a negative voltage bias to control the transmission mode linearity. This reduces the circuit complexity and size, and costs. Third, the multiple band isolation mode eliminates the need for multiple quarter-wave sections. This reduces the circuit complexity and size, and costs. Fourth, the termination impedance can be implemented with discrete components. Fifth, optimum antenna termination impedance for multiple frequency bands can be selected via the control signals. Sixth, the frequency bandwidth and tuning resolution can be modularly extended with additional termination stages.

While preferred embodiments have been shown and described, it will be understood that they are not intended to limit the disclosure, but rather it is intended to cover all modifications and alternative methods and apparatuses falling within the spirit and scope of the invention as defined in the appended claims or their equivalents.

What is claimed is:

1. A method of adjusting impedance in a multiple antenna system, comprising:

detecting whether a first signal source connected with a first antenna via a first signal path is active or inactive;

detecting whether a second signal source connected with a second antenna via a second signal path is active or inactive, wherein the second antenna is disposed proximate to the first antenna to within approximately one wavelength or less; and selectively connecting a first parallel impedance circuit in parallel with the first signal path if the first signal source is inactive and the second signal source is active to reduce electromagnetic coupling between the second and first antennas.

2. The method of claim 1, further comprising:

measuring external interference proximate to the first antenna; and adjusting the impedance of the first parallel impedance circuit based on the measured external interference.

3. The method of claim 1, further comprising:

detecting whether a third signal source connected with a third antenna via a third signal path is active or inactive, wherein the third antenna is proximate to the first antenna to within approximately one wavelength or less; and selectively connecting a first parallel impedance circuit in parallel with the first signal path if the first signal source is inactive and the third signal source is active to reduce electromagnetic coupling between the third and first antennas.

4. The method of claim 1, wherein the first parallel impedance circuit comprises a plurality of selectively connectable parallel impedance circuits, and wherein selectively connecting said first parallel impedance circuit in parallel with the first signal path if the first signal source is inactive and the second signal source is active to reduce electromagnetic coupling between the second and first antennas includes selectively attaching a selected one of the plurality of parallel impedance circuits in parallel with the first signal path.

5. The method of claim 1, further including selectively connecting a second parallel impedance circuit with the second signal path if the first signal source is active and the second signal source is inactive to reduce electromagnetic coupling between the first and second antennas.

6. The method of claim 1, wherein the first parallel impedance circuit comprises a plurality of parallel impedance circuits, and wherein selectively connecting said first parallel impedance circuit in parallel with the first signal path if the first signal source is inactive and the second signal source is active to reduce electromagnetic coupling between the second and first antennas includes selecting a desired parallel impedance, selecting from the plurality of parallel impedance circuits one or more parallel impedance circuits that most closely match the desired parallel impedance, and attaching the one or more selected parallel impedance circuits in parallel with the first signal path.

7. A method of adjusting impedance in a multiple antenna system comprising:

detecting whether a first signal source operatively connected with a first antenna via a first signal path is active or inactive;

detecting whether a second signal source simultaneously operatively connected with a second antenna via a second signal path is active or inactive; and selectively connecting a first parallel impedance circuit in parallel with the first signal if the first signal source is inactive and the second signal source is active to reduce electromagnetic coupling between the second and first antennas.

* * * * *